United States Patent [19]

Lewis

[11] 4,417,370

[45] Nov. 29, 1983

[54] POCKET HANDKERCHIEF CLIP

[76] Inventor: Shawn D. Lewis, P.O. Box 1965, Ruston, La. 71270

[21] Appl. No.: 410,319

[22] Filed: Aug. 23, 1982

[51] Int. Cl.[3] ..... A47L 25/08; A44B 21/00

[52] U.S. Cl. ..... 24/3 L; 24/3 J; 24/1; 24/501; 15/104 A

[58] Field of Search ..... 24/137 R, 137 A, 3 J, 24/3 L, 1; 15/104 A; 40/19, 314

[56] References Cited

U.S. PATENT DOCUMENTS

| | | | |
|---|---|---|---|
| 2,762,101 | 9/1956 | Almer | 24/137 A |
| 2,844,913 | 7/1958 | Brill, Jr. | 24/3 J |
| 3,192,585 | 7/1965 | Montag | 24/137 A |
| 3,306,266 | 2/1967 | McCunney | 40/19 |
| 3,421,170 | 1/1969 | Thomas, Jr. | 15/104 A |
| 4,312,089 | 1/1982 | Taylor | 24/137 R |

*Primary Examiner*—Robert P. Swiatek
*Assistant Examiner*—David I. Tarnoff

[57] ABSTRACT

A pocket handkerchief clip which is spring-biased to receive a folded handkerchief or a shaped handkerchief accessory, and is designed to fit into the front pocket of a suit coat, jacket or sport coat for displaying the handkerchief or handkerchief accessory at the top of the pocket. In a preferred embodiment the clip is attached to a lint-removing member or pad which serves to support the clip in the pocket, and the lint pad includes a retractable thread knife for removing loose threads from clothing.

9 Claims, 7 Drawing Figures

POCKET HANDKERCHIEF CLIP

BACKGROUND OF THE INVENTION

1. Field of the Invention

This invention relates to decorative pocket handkerchiefs and handkerchief accessories for suit coats, jackets and sport coats, and more particularly, to a pocket handkerchief clip which is spring-biased to receive a folded pocket handkerchief or handkerchief accessory in displayed position at the top of the front coat pocket. The pocket handkerchief clip can be sized to fit substantially any pocket, and in a preferred embodiment, is supported by a lint pad which can be threadably mated with the clip to support the clip in the pocket and provide a means for removing lint from the coat, trousers or other article of clothing, as the need arises. A lint pad handle is also provided as an optional feature for supporting the lint pad, and in a preferred embodiment a thread knife is retractably or slidably mounted in the lint pad to remove loose threads from the jacket or other article of clothing.

2. Description of the Prior Art

Pocket handkerchiefs and other decorative handkerchief pieces or accessories for sport coats, suit coats and jackets are well known in the prior art. Depending upon the particular style in vogue at the time, handkerchiefs are folded in a variety of ways to project either an edge or one or more corners of the handkerchief from the top of the jacket or coat pocket in a decorative manner to enhance the appearance of a jacket, suit coat or sport coat. Thus, handkerchiefs of various size, shape and color, as well as shaped handkerchief accessories are frequently used in such a decorative way, and in some cases the handkerchiefs are simply placed at random in the pocket to project a portion of the handkerchief from the top of the pocket. One of the problems associated with the conventional use of handkerchiefs in such a decorative way in the pockets of jackets, suits and sport coats is the relatively small size of the handkerchief in comparison with the depth of the pocket in which it is placed. For example, if it is desired to project one or more corners of the handkerchief from the top of the pocket, regardless of the care with which the handkerchief is folded to achieve this goal, it sometimes slips down into the pocket and frequently will not stay in position without the assistance of pins or other fastening means. Furthermore, in the case of the shaped handkerchief decoration accessories which are frequently sewn or glued to paper or cardboard supports, the supports usually curl or bend with use, and are rendered unfit to support the projecting accessory, causing the decorative portion of the handkerchief accessory to slide into the pocket.

Consequently, it is very difficult to use a shaped handkerchief accessory or a conventional handkerchief in the pocket of a suit, sport coat or jacket without the necessity of using pins or other fasteners to prevent the projecting area of the handkerchief or shaped accessory from slipping into the pocket.

Accordingly, it is an object of this invention to provide a clip for insertion in the front pocket of a suit coat, jacket or sport coat and engaging and supporting a pocket decoration accessory in order to project a desired portion of the pocket handkerchief or decoration accessory from the top of the pocket as a decorative item.

Another object of the invention is to provide a new and improved spring-biased clip for receiving one edge or a portion of a pocket handkerchief or a pocket decoration accessory and insertion in the pocket of a suit coat, jacket or sport coat to support the handkerchief or accessory, and permit a desired portion of the handkerchief or accessory to project from the top of the pocket.

Still another object of the invention is to provide a pocket handkerchief clip which is characterized by a pair of cooperating frame members which can be opened against a bias by finger pressure to receive a pocket handkerchief or handkerchief accessory piece, and then positioned in the pocket of a jacket, suit coat or sport coat to support the pocket handkerchief or accessory and facilitate projecting a desired portion of the handkerchief or accessory from the pocket as a decorative piece.

Still another object of this invention is to provide a new and improved pocket handkerchief clip which is characterized by a shaped base frame and a cooperating clip frame joined by a length of shaped, tensioned wire to bias a handkerchief or handkerchief decoration accessory between the clip frame and the base frame, and a cooperating lint pad which is removably joined to the base frame to support the base frame when the base frame and the cooperating lint pad are placed in the pocket of a suit coat, jacket or sport coat to support the handkerchief or handkerchief accessory and permit a selected portion of the handkerchief or accessory to project from the top of the pocket as a decorative item to the suit coat, sport coat or jacket.

Yet another object of the invention is to provide a pocket handkerchief clip and lint pad combination for receiving a handkerchief or handkerchief decoration accessory and supporting the handkerchief or accessory in the pocket of a suit coat, jacket or sport coat, which clip is further characterized by a clip frame and a cooperating base frame joined by a tensioned, resilient wire member, and a lint pad which threadably mates with the clip to support the clip in the pocket of a sport coat, suit coat or jacket to facilitate projection of a desired portion of the handkerchief or handkerchief decoration accessory tip from the top of the pocket, the pocket handkerchief clip assembly further comprising a handle for attachment to the lint pad when the lint pad is removed from the clip in order to support the lint pad while the pad is used to remove lint from the clothing and a thread knife in the lint pad for removing loose threads from the clothing.

SUMMARY OF THE INVENTION

These and other objects of the invention are provided in a pocket handkerchief clip for engaging and supporting a folded decorative handkerchief or handkerchief accessory, which clip is characterized by a shaped clip frame and a cooperating base frame joined by a shaped, tensioned wire member to facilitate opening and closing of the clip frame with respect to the base frame by application of finger pressure, and a lint pad in threadable cooperation with the clip in order to support the clip in the pocket of a suit coat, sport coat or jacket to facilitate projection of a desired portion of the handkerchief or accessory tip from the top of the pocket and to prevent the handkerchief or accessory tip from sliding into the pocket responsive to movement of the wearer. In a preferred embodiment of the invention the lint pad contains a thread knife having a point and a blade located on a shank which is retractably or slidably mounted in the pad for removing loose threads from the jacket or coat, or other article of clothing.

BRIEF DESCRIPTION OF THE DRAWING

The invention will be better understood by reference to the accompanying drawing, wherein.

DESCRIPTION OF THE PREFERRED EMBODIMENT

Figure 1:
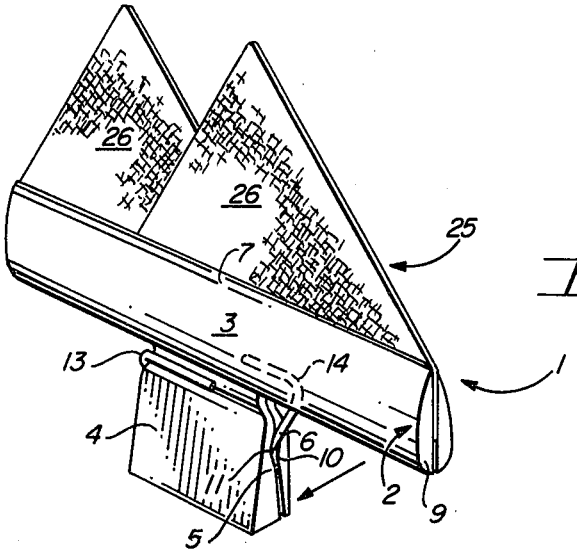
FIG. 1 is a perspective view of a preferred embodiment of the pocket handkerchief of this invention.
Figure 2:
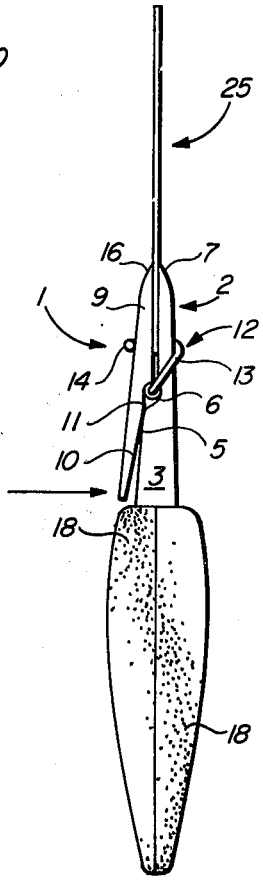
FIG. 2 is a side elevation of the pocket handkerchief clip illustrated in FIG. 1, with a lint pad provided in cooperation with the clip.
Figure 3:
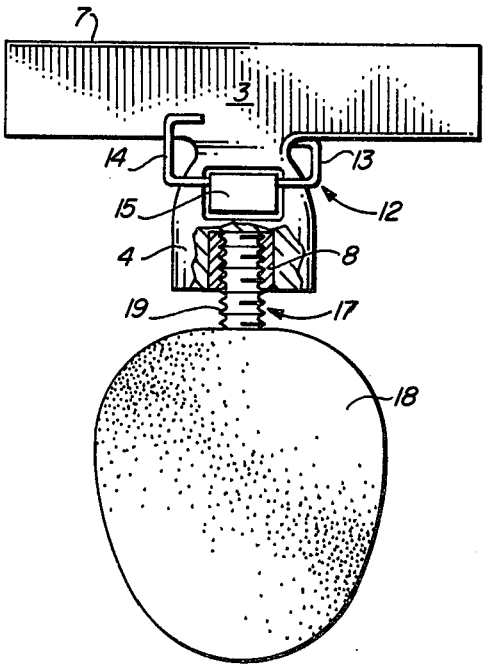
FIG. 3 is a front elevation, partially in section, illustrating the base frame member of the pocket handkerchief clip, and a preferred technique of mounting the lint pad on the base frame.

Referring now to FIGS. 1–3 of the drawing, in a preferred embodiment, the pocket handkerchief clip of this invention is generally illustrated by reference numeral 1, and includes a clip frame 2, which is characterized by a shaped base frame 3 and a cooperating pivot frame 9. The base frame 3 includes a base frame handle 4 extending downwardly from the base frame 3 and shaped to define a fulcrum 5, projecting inwardly of the base frame handle 4. A base frame notch 6, is provided adjacent and above the fulcrum 5 in base frame handle 4, in order to accommodate the base frame arm 13 of a tension wire 12, which is more particularly illustrated in FIG. 3 of the drawing. In a most preferred embodiment of the invention the base frame 3 is tapered from base frame handle 4 to define a base frame tip 7, which extends the entire length of the top edge of the base frame 3, as illustrated. The pivot frame 9 is shaped substantially as a mirror image of the base frame 3, and is provided with a pivot frame handle 10 extending downwardly from the pivot frame 9 and shaped to contact the base frame handle 4 at the fulcrum 5. A pivot frame notch 11 is provided in pivot frame handle 10 adjacent the base frame notch 6 in base frame handle 4, in order to further accommodate the base frame arm 13, as hereinafter described.

Referring now specifically to FIGS. 2 and 3 of the drawing, in another preferred embodiment of the invention the pocket handkerchief clip 1 is provided with a cooperating, removable lint pad 18, having a lint pad nipple 17, fitted with nipple threads 19, projecting from the top thereof. Lint pad nipple 17 is positioned for threadable engagement with internal threads [not illustrated] in the handle seat 8, which is secured inside the base frame handle 4, as illustrated in FIG. 3. Accordingly, when lint pad 18 is secured to the base frame handle 4 by means of lint pad nipple 17, the pocket handkerchief clip 1 and lint pad 18 are configured as illustrated in FIG. 2 of the drawing. As further illustrated in FIGS. 1 and 2 of the drawing, a pocket decoration accessory 25, consisting of a pair of accessory tips 26, is positioned between the base frame tip 7 and the pivot frame tip 16, in order to secure the pocket decoration accessory 25 in pocket handkerchief clip 1, as hereinafter described. In a typical embodiment of the invention the pocket decoration accessory 25 can be shaped from a cloth such as the material used to manufacture handkerchiefs, and in an alternative embodiment, a full-sized handkerchief can be folded and placed between the base frame tip 7 and pivot frame tip 16, as desired. However, for purposes of illustration, a pocket decoration accessory 25 which includes single and double decoration tips 26 is referred to in this application in nonexclusive particular, and the term "pocket decoration accessory 25" is used to describe either a handkerchief or a pocket decoration accessory of selected design.

Referring now to FIG. 3 of the drawing, in a most preferred embodiment of the invention the base frame 3 and pivot frame 9 are joined by a tension wire 12, which is fitted through a hollow tension cylinder 15, located in the base frame handle 4. Tension wire 12 is shaped to define an upward and rearwardly extending base frame arm 13, which extends around base frame handle 4 and engages the opposite side of base frame handle 4 from the tension cylinder 15. A clip frame arm 14 extends forwardly of, and around the pivot frame handle 10 of pivot frame 9, as illustrated in FIGS. 1 and 2, such that depression of the pivot frame handle 10 in the direction of the arrows illustrated in FIGS. 1 and 2 causes the base frame tip 7 and the pivot frame tip 16 to diverge as the pivot frame handle 10 pivots on fulcrum 5. This action facilitates the insertion of the pocket decoration accessory 25 between the base frame tip 7 and the pivot frame tip 16, with the bias in base frame arm 13 and clip frame arm 14 serving to press the base frame tip 7 and the pivot frame tip 16 together against the pocket decoration accessory 25 when pressure is released from the pivot frame handle 10. Tension wire 12 can be shaped from a wire stock which is suitably formed with spring tension to permit bending and return to the original configuration without exceeding the elastic limit.

Figure 5:
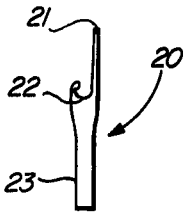
FIG. 5 is a side elevation of the knife thread carried by the lint pad.
Figure 4:
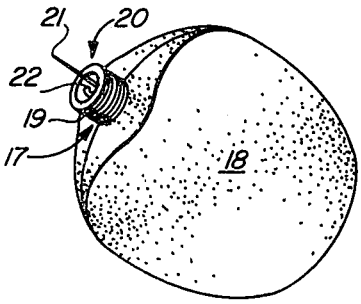
FIG. 4 is a perspective view of a preferred lint pad and retractable thread-cutting knife.

Referring now to FIGS. 4 and 5 of the drawing, in another most preferred embodiment of the invention a thread knife 20 is adjustably and retractably mounted in the interior of the lint pad 18 with the point 21 and blade 22 extending upwardly inside the lint pad nipple 17, as particularly illustrated in FIG. 4. Accordingly, in this embodiment, the point 21 of the thread knife 20 can be grasped and pulled upwardly to extend the blade 22 and the point 21 from the interior of the lint pad 18 and the lint pad nipple 17 to expose the blade 22 and the point 21 and facilitate the isolation and cutting of loose threads from clothing such as the coat or trousers, in nonexclusive particular. Accordingly, since the shank 23 of the thread knife 20 is slidably or retractably engaged in a base [not illustrated] located inside the lint pad 18, the point 21 and blade 22 can be retracted inside the lint pad nipple 17 of lint pad 18 when it is desired to threadably engage the lint pad nipple 17 with the base frame handle 4 of the base frame 3.

Figure 6:
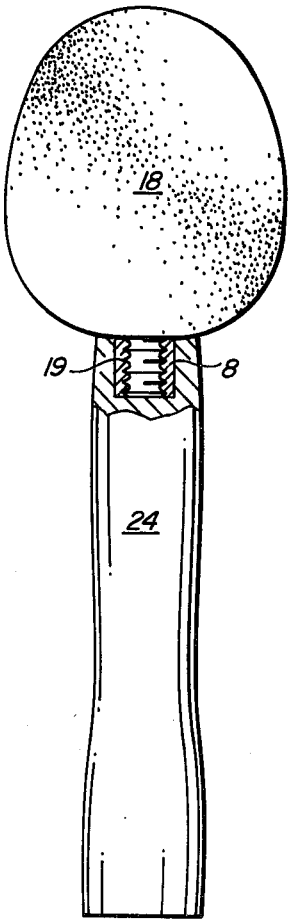
FIG. 6 is a front elevation, partially in section, of the lint pad and optional carrying handle.

Referring now to FIG. 6 of the drawing in yet another preferred embodiment of the invention the lint pad 18 is provided with a lint pad handle 24, which is provided with a handle seat 8 for receiving the nipple threads 19 of the lint pad nipple 17 and securing the lint pad 18 to the lint pad handle 24. In this manner the lint pad 18 can be easily and conveniently used to remove lint from various articles of clothing, as desired. It will be appreciated from a consideration of FIGS. 2 and 3 of the drawing that the lint pad 18 can also be used to remove lint from clothing while attached to the base frame 3, as an alternative feature of the invention.

Figure 7:
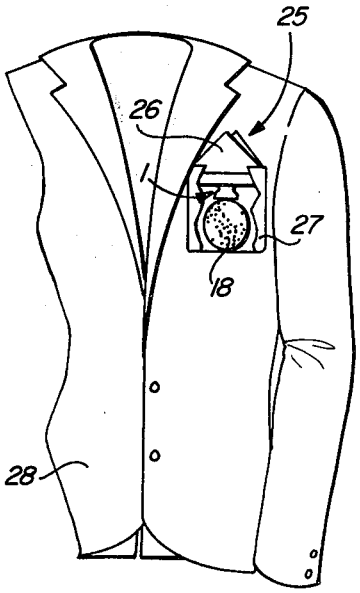
FIG. 7 is a front elevation, partially in section, of a typical suit coat, sport coat or jacket with a pocket handkerchief clip and lint pad assembly in position supporting a handkerchief or handkerchief decoration accessory.

Referring now to FIG. 7 of the drawing, when it is desired to use the pocket handkerchief clip 1 in cooperation with the lint pad 18 to support a pocket decoration accessory 25, the pocket decoration accessory 25 is initially positioned as desired in the clip frame 2, and the lint pad 18 is threadably connected to the base frame 3 by engaging the nipple threads 19 in lint pad nipple 17 with the internal threads [not illustrated] in the handle seat 8, which is embedded in the base frame handle 4 of base frame 3, as illustrated in FIG. 3. The lint pad 18 is thus securely attached to the base frame handle 4, as illustrated in FIG. 2. The entire pocket handkerchief clip 1 and lint pad 18 combination is then inserted in the pocket 27 of a coat 28, as illustrated in FIG. 7, to support the decoration tip 26 of pocket decoration accessory 25 in extended position from the top of the pocket 27. It will be appreciated by those skilled in the art that the lint pad nipple 17 of lint pad 18 can be threadably inserted in the handle seat 8 to a desired extent which permits the clip frame 2 to be concealed beneath the top edge of the pocket 27 in order to securely support the decoration tip 26 of pocket decoration accessory 25. Furthermore, when it is desired to remove lint from the coat 28 or other clothing, the pocket handkerchief clip 1 and lint pad 18 assembly can be removed from the pocket 27 and the lint pad 18 used to facilitate the removal of lint. If extensive lint removal is necessary, the lint pad 18 can be threadably removed from the base frame handle 4 of clip frame 2 and subsequently threadably inserted on lint pad handle 24, as illustrated in FIG. 6 to clean the garment or garments. Furthermore, in the event that loose threads need to be removed from the clothing, the lint pad 18 can be threadably removed from the clip frame 2 as heretofore described, the thread knife 20 extended from the interior of lint pad 18 and lint pad nipple 17, and the point 21 or the blade 22 used to remove the threads.

Having described my invention with the particularity set forth above, what is claimed is:

1. A pocket handkerchief clip for supporting a handkerchief decoration accessory in a pocket comprising:

(a) a base frame having an elongated top portion; a base frame handle extending from said base frame and a fulcrum on one side of said base frame handle;

(b) a pivot frame substantially coextensive with said base frame and having an elongated top portion and a pivot frame handle extending from said pivot frame adjacent said base frame handle and engaging said fulcrum on said base frame;

(c) bias means engaging said base frame handle and said pivot frame handle and biasing at least a portion of said base frame against said pivot frame and said pivot frame handle against said fulcrum to close at least a portion of said pivot frame against said base frame; and further comprising a lint pad rigidly secured closely adjacent said base frame handle at the end opposite of said elongated top portions for supporting said pocket handkerchief clip in the pocket.

2. The pocket handkerchief clip of claim 1 wherein said base frame is tapered from said base frame handle to define a base frame tip and said pivot frame is tapered from said pivot frame handle to define a pivot frame tip adjacent said base frame tip for securing the handkerchief decoration accessory between said base frame and said pivot frame.

3. The pocket handkerchief clip of claim 1 wherein said bias means is a wire member extending through said base frame handle and having a base frame arm engaging said base frame handle and a clip frame arm engaging said pivot frame handle.

4. The pocket handkerchief clip of claim 1 wherein:

(a) said base frame is tapered from said base frame handle to define a base frame tip and said pivot frame is tapered from said pivot frame handle to define a pivot frame tip adjacent said base frame tip for securing the handkerchief decoration accessory between said base frame and said pivot frame; and (b) said bias means is a tension cylinder positioned in said base frame handle and a wire member extending through said tension cylinder and having a base frame arm engaging said base frame handle and clip frame arm engaging said pivot frame handle.

5. The pocket handkerchief clip of claim 1 further comprising a thread knife slidably mounted in said lint pad for removing threads from clothing.

6. The pocket handkerchief clip of claim 1 further comprising an exteriorly threaded nipple on said lint pad and an interiorly threaded handle seat in said base frame handle, and wherein said threaded nipple is threadably inserted in said handle seat for removably joining said lint pad to said base frame handle.

7. The pocket handkerchief of claim 1 further comprising:

(a) An exteriorily threaded nipple on said lint pad and an interiorly threaded handle seat in said base frame handle, and wherein said threaded nipple is threadably inserted in said handle seat for removably joining said lint pad to said base frame handle; and (b) a thread knife slidably mounted in said lint pad for removing threads from clothing.

8. A pocket handkerchief clip for engaging a handkerchief decoration accessory and supporting the accessory in a pocket of a coat comprising:

(a) a base frame having an elongated base frame tip along one edge, a base frame handle extending from said base frame opposite said one edge and a fulcrum on one side of said base frame handle;

(b) a pivot frame substantially coextensive with said base frame and having an elongated pivot frame tip substantially coextensive with said base frame tip, and a pivot frame handle extending from said pivot frame adjacent said base frame handle and engaging said fulcrum on said base frame handle;

(c) a tension cylinder positioned in said base frame handle and a wire member extending through said tension cylinder and having a base frame arm engaging said base frame handle and a clip frame arm engaging said pivot frame handle and further comprising a lint pad having a threaded nipple on one end, and an interiorly threaded nipple seat in said base frame handle, and wherein said threaded nipple is threadibly inserted in said interiorly threaded nipple seat for removably joining said lint pad to said base frame handle at the end opposite said base frame tip.

9. The pocket handkerchief clip of claim 8 further comprising a thread knife slidably mounted in said lint pad and extending through said threaded nipple for removing threads from clothing.

* * * * *